US010837216B2

(12) United States Patent
Cheng et al.

(10) Patent No.: US 10,837,216 B2
(45) Date of Patent: Nov. 17, 2020

(54) GARAGE ENTRY SYSTEM AND METHOD

(71) Applicant: The Chamberlain Group, Inc., Oak Brook, IL (US)

(72) Inventors: Fred T. Cheng, Los Altos Hills, CA (US); Herman Yau, Sunnyvale, CA (US)

(73) Assignee: The Chamberlain Group, Inc., Oak Brook, IL (US)

( * ) Notice: Subject to any disclaimer, the term of this patent is extended or adjusted under 35 U.S.C. 154(b) by 177 days.

(21) Appl. No.: 16/018,387

(22) Filed: Jun. 26, 2018

(65) Prior Publication Data

US 2019/0390504 A1 Dec. 26, 2019

(51) Int. Cl.
*E05F 15/73* (2015.01)
*E05F 15/77* (2015.01)

(52) U.S. Cl.
CPC ..... *E05F 15/73* (2015.01); *E05F 15/77* (2015.01); *E05F 2015/767* (2015.01)

(58) Field of Classification Search
CPC ..... E05F 15/73; E05F 15/77
See application file for complete search history.

(56) References Cited

U.S. PATENT DOCUMENTS

| | | | | |
|---|---|---|---|---|
| 6,721,501 | B2 | 4/2004 | Komatsu | |
| 7,012,523 | B2 | 3/2006 | Stuart | |
| 8,487,998 | B2 | 7/2013 | Chen | |
| 9,679,453 | B2 | 6/2017 | Flint et al. | |
| 9,715,772 | B2 | 7/2017 | Bauer et al. | |
| 9,830,790 | B2 | 11/2017 | Jones | |
| 9,836,642 | B1 | 12/2017 | Ramaswamy | |
| 9,865,155 | B2 | 1/2018 | Cobb et al. | |
| 9,879,466 | B1 * | 1/2018 | Yu | G07C 9/257 |
| 2003/0175027 | A1 | 9/2003 | Komatsu | |
| 2004/0117638 | A1 | 6/2004 | Monroe | |
| 2006/0221183 | A1 | 10/2006 | Sham | |
| 2008/0247609 | A1 | 10/2008 | Feris | |
| 2009/0091618 | A1 | 4/2009 | Anderson | |
| 2010/0013925 | A1 | 1/2010 | Fowler | |
| 2010/0150407 | A1 | 6/2010 | Cheswick | |

(Continued)

FOREIGN PATENT DOCUMENTS

| | | | |
|---|---|---|---|
| CN | 103606210 | A | 2/2014 |
| JP | 2007122480 | A | 5/2017 |

OTHER PUBLICATIONS

U.S. Appl. No. 16/018,370, filed Jun. 26, 2018, 22 pages.

(Continued)

*Primary Examiner* — Leon Flores
(74) *Attorney, Agent, or Firm* — Fitch, Even, Tabin & Flannery LLP

(57) ABSTRACT

A garage door security system includes a camera configured to capture images of vehicles that are in proximity of a garage door of a garage. A database stores identification information for a plurality of vehicles. The identification information includes at least one of make, model, color, license plate number. An image and data analytic controller analyzes the images of vehicles captured by the camera using the identification information for the plurality of vehicles stored in the local database in order to identify vehicles authorized to enter the garage. A motor control opens the garage door for vehicles authorized to enter the garage.

19 Claims, 4 Drawing Sheets

(56) References Cited

U.S. PATENT DOCUMENTS

| | | | |
|---|---|---|---|
| 2010/0259618 | A1 | 10/2010 | Chen |
| 2012/0113253 | A1 | 5/2012 | Slater |
| 2013/0016211 | A1 | 1/2013 | Yeh |
| 2013/0021473 | A1 | 1/2013 | Yeh |
| 2014/0139666 | A1 | 5/2014 | Wei |
| 2014/0267716 | A1 | 9/2014 | Child |
| 2014/0375752 | A1 | 12/2014 | Shoemake |
| 2015/0124091 | A1 | 5/2015 | Stahl |
| 2015/0145993 | A1 | 5/2015 | Scalisi |
| 2015/0163535 | A1 | 6/2015 | McCarthy, III |
| 2016/0232763 | A1 | 8/2016 | Sockol |
| 2016/0247344 | A1 | 8/2016 | Eichenblatt |
| 2016/0364927 | A1 | 12/2016 | Barry et al. |
| 2017/0034485 | A1 | 2/2017 | Scalisi |
| 2017/0084132 | A1 | 3/2017 | Scalisi |
| 2017/0107752 | A1 | 4/2017 | Dvir et al. |
| 2017/0169636 | A1 | 6/2017 | Piche et al. |
| 2017/0022087 | A1 | 8/2017 | Child et al. |
| 2017/0217372 | A1 | 8/2017 | Lu et al. |
| 2017/0220872 | A1 | 8/2017 | Child et al. |
| 2017/0230120 | A1 | 8/2017 | Okabe |
| 2017/0301202 | A1 | 10/2017 | Jones |
| 2017/0323498 | A1 | 11/2017 | Bauer |
| 2017/0332055 | A1 | 11/2017 | Henderson |
| 2017/0345267 | A1 | 11/2017 | Flint et al. |
| 2018/0061158 | A1 | 3/2018 | Greene |
| 2018/0061558 | A1 | 3/2018 | Greene |
| 2018/0070136 | A1 | 3/2018 | McCarthy, III |
| 2018/0102914 | A1 | 4/2018 | Kawachi |
| 2018/0114390 | A1 | 4/2018 | Dong |
| 2018/0184050 | A1 | 6/2018 | Chuter |
| 2019/0063140 | A1* | 2/2019 | Trundle ..... G06K 9/325 |
| 2019/0392691 | A1 | 12/2019 | Cheng |

OTHER PUBLICATIONS

U.S. Appl. No. 16/018,370, Final Office Action dated Jun. 8, 2020; 40 pages.

U.S. Appl. No. 16/018,370, filed Dec. 10, 2019, 20 pages.

* cited by examiner

GARAGE ENTRY SYSTEM AND METHOD

BACKGROUND

Automated garage door openers utilize a garage door opener remote controller to wirelessly send a valid signal (Generation-1) or secret code (Generation-2) to a garage door opener to open or close a garage door. Typically, the garage door opener will stop operation when a sensor detects a person or object is in the path of a closing garage door.

Apps are also currently available to link a garage door opener to a smart phone. This allows use of the smart phone to open and close the garage door and allows notifications to be received that indicate when the garage door is open and shut.

DETAILED DESCRIPTION

Figure 1:
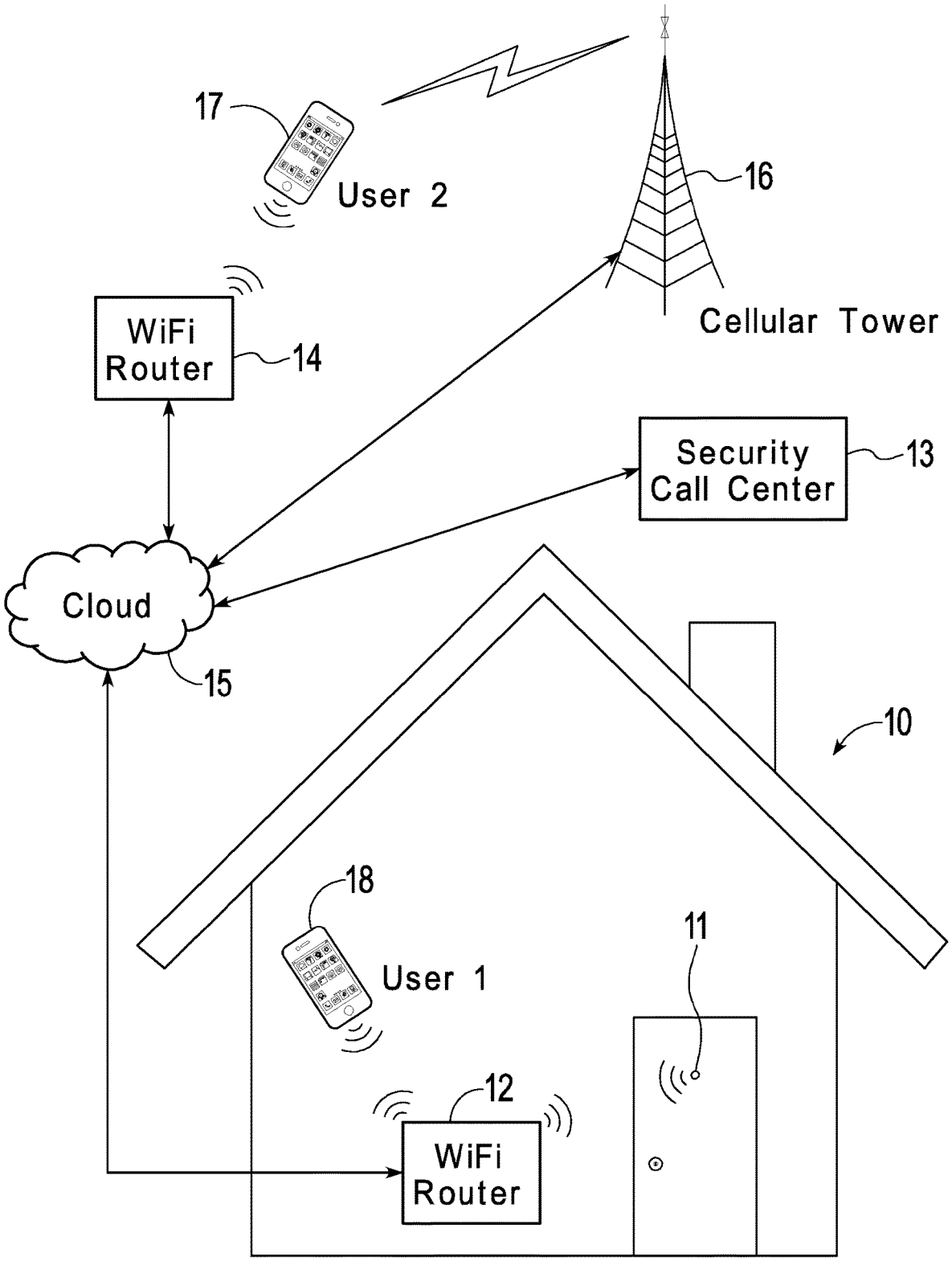
FIG. 1 shows a simplified diagram of components of an entry security system in accordance with an implementation.

FIG. 1 shows an entry security system 11 on a door of a building 10. Entry security system 11 allows people and activities located outside a door to be observed from inside the building or from remote locations without opening the door. For example, entry security system 11 includes image sensors on the door or other nearby locations that captures image and video. The video is shown on a device mounted on the interior of the door or broadcast to other remote locations. A user 18 can view the real time video showing images of activity outside the door. User 18 can make the viewing using a smart phone, a tablet computing system, a laptop or desktop computer, a monitor mounted on an interior wall located in proximity of the door or through some other monitoring system. The video can also be stored and reviewed at a later time. Connection to user 18 can be wired or wireless, for example, using a Wi-Fi router 12.

When Wi-Fi router 12 is connected to the Internet, this allows a remote user 17 to utilize cloud computing through cloud 15 to interact with entry security system. For example, user 17 is connected to cloud 15 via a cellular tower 16, a Wi-Fi router 14 or by some other communication connection. A cloud-linked video entry security monitor allows people to see the outside and check the person at or near the door without opening the door or peeping through the hole.

Video capture can be triggered, for example, by a passive infrared (PIR) sensor that detects motion outside the building. Alternatively, or in addition, depressing a doorbell button activates a doorbell function and enables video capture.

Local user 18 or remote user 17 can talk with a person near the door of building 10 door through a 2-way audio capability built into entry security system 11. For example, entry security system 11 includes facial recognition capability that enables identification of a person near the door of building 10. A security call center 13 can be notified in appropriate circumstances in accordance with a protocol stored within entry security system 11 or when desired by remote user 17 or user 18. For example, entry security system 11 can be programmed to automatically generate a dispatch call when entry security system 11 recognizes a person as unwanted or dangerous, or can be programmed to automatically generate a dispatch call when entry security system 11 does not recognize a person.

Figure 2:
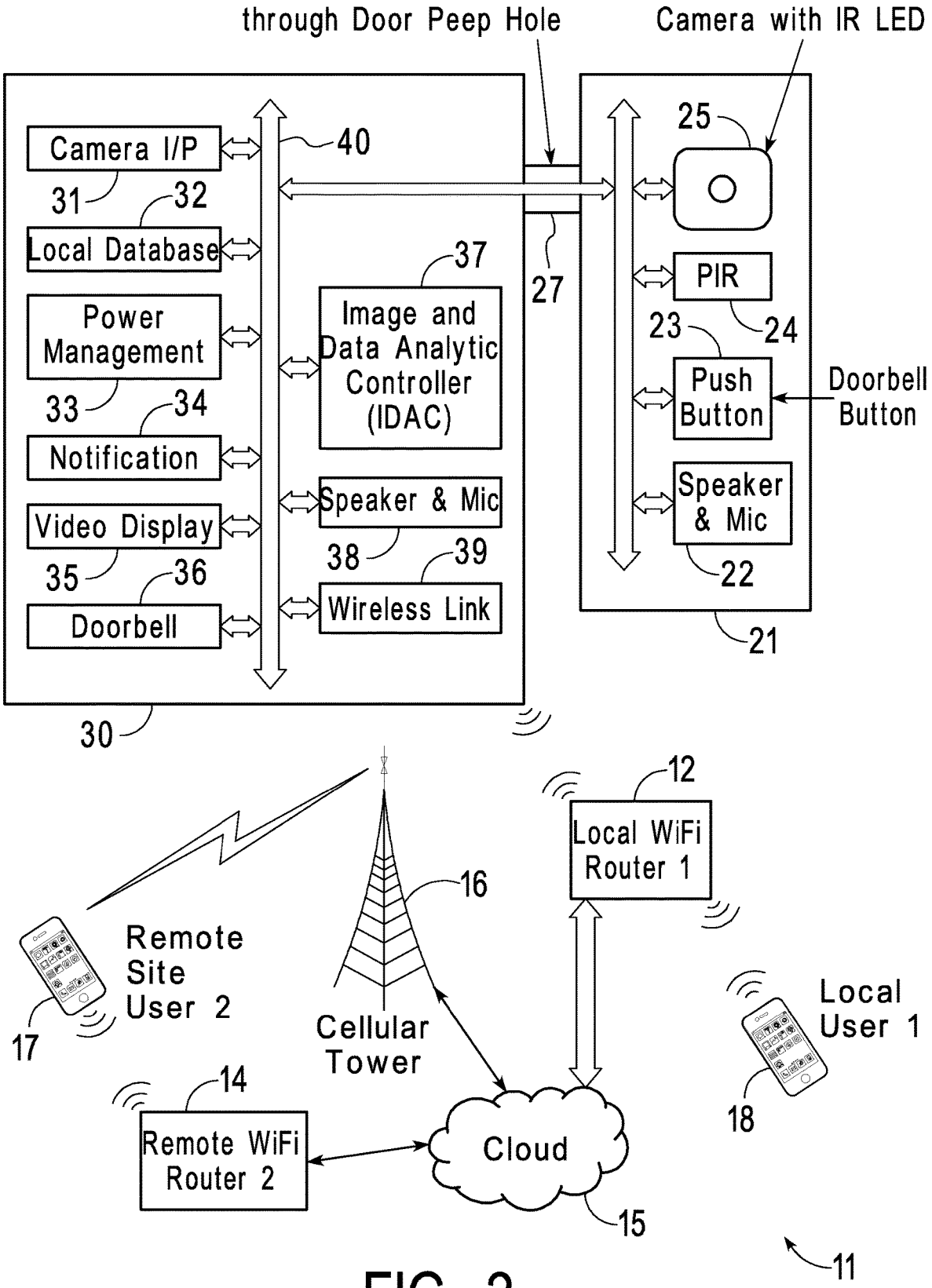
FIG. 2 shows a simplified block diagram providing additional detail of components of an entry security system in accordance with an implementation.

For example, entry security system 11 can be allocated into two parts, as shown in FIG. 2. One part is an exterior module 21 located at or near the door of building 10. A second part is an interior module 30 located, for example, within building 10.

For example, FIG. 2 shows exterior module 21 includes a camera 25 with an infrared light emitting diode (LED), a PIR sensor 24, a doorbell button 23 and a speaker and microphone system 22 connected, for example, via a bus. Wireless, wired or optical communication is provided, for example through a door peep hole 27, to an interior module 30.

Interior module 30 includes, for example, a camera internet protocol (I/P) interface 31, a local database 32, a power management block 33, a notification block 34, a video display interface block 35, a doorbell block 36, an image and data analytic controller (IDAC) 37, a speaker and microphone system 38 and a wireless link block 39 interconnected by a bus system 40. User 18, remote user 17 and other users can upload identification information into local database 32. The identification information can include names, contact information and photo information that can be used for identification and for facial recognition purposes.

For example, IDAC 37 extracts and analyzes image data captured from camera 25 and uses image information stored in local database 32 or an external database to perform facial recognition, for example on a person in front of a door of building 10. Once recognized, name, photo identification information and so on can be displayed to user 18 or remote user 17. The information stored in local database 32, for example, can indicate whether this is a desirable person or an undesirable person. This information can be displayed to user 18 or remote user 17. In addition, this information can be used in a protocol that enables automatic opening of the door to building 10 and notifications directed to a particular pre-identified user interested in visits by the recognized person or directed to security call center 13. Such recognition capability can also, for example, be used to identify pets for example, to trigger opening and closing pet doors.

Video display to user 18 and remote user 17 can be real time or delayed. For example, video can be streamed to user 18 and/or remote user 17. Alternatively, or in addition, notifications, images and/or video can be sent by SMS text message, e-mail, or some other messaging system.

The use of PIR sensor 24 to trigger capture of images or video conserves battery power and limits the amount of video taken. For example, camera 25 has a wide-angle lens to allow wider field of view (FOV) to easily observe a wide area. Built-in IR LED capability allows for images to be captured when it is dark outside building 10.

For example, PIR sensor 24 and doorbell button 23 activate camera 25. Alternatively, camera I/P interface 31 activates camera 25 based on signals received from PIR sensor 24 and doorbell button 23.

For example, doorbell block 36 stores various chimes that may be selected by a user. Entry security system 11 sound the selected chime every time doorbell button 23 is depressed. Entry security system 11 also activates the IDAC block 37 operation to analyze video images captured by camera 25.

Wireless link block 39 sends video/audio data wirelessly between entry security system 11 and user 18 and/or remote user 17. Wireless link block 39 enables user 18 and/or remote user 17 to use computing devices such as a smart phone, a tablet computer, a laptop computer or a desk computer to talk with someone near the door of building 10.

For example, sensitivity of PIR sensor 24 is adjusted to trigger camera 25 to capture images when motion is detected within a selected distance range.

For example, interior module 30 can include a monitor, speaker and microphone to allow a user in the vicinity of interior module 30 to view images captured by camera 25 in real time and to interact with people in the vicinity of exterior module 21. This gives a user an option to use interior module 30, a computing device inside building 10, or a computing device remote from building 10 to communicate with those in vicinity of exterior module 21. The computing device is, for example, a smartphone, tablet computer, portable computer, desktop computer or any other type of computing device.

Figure 3:
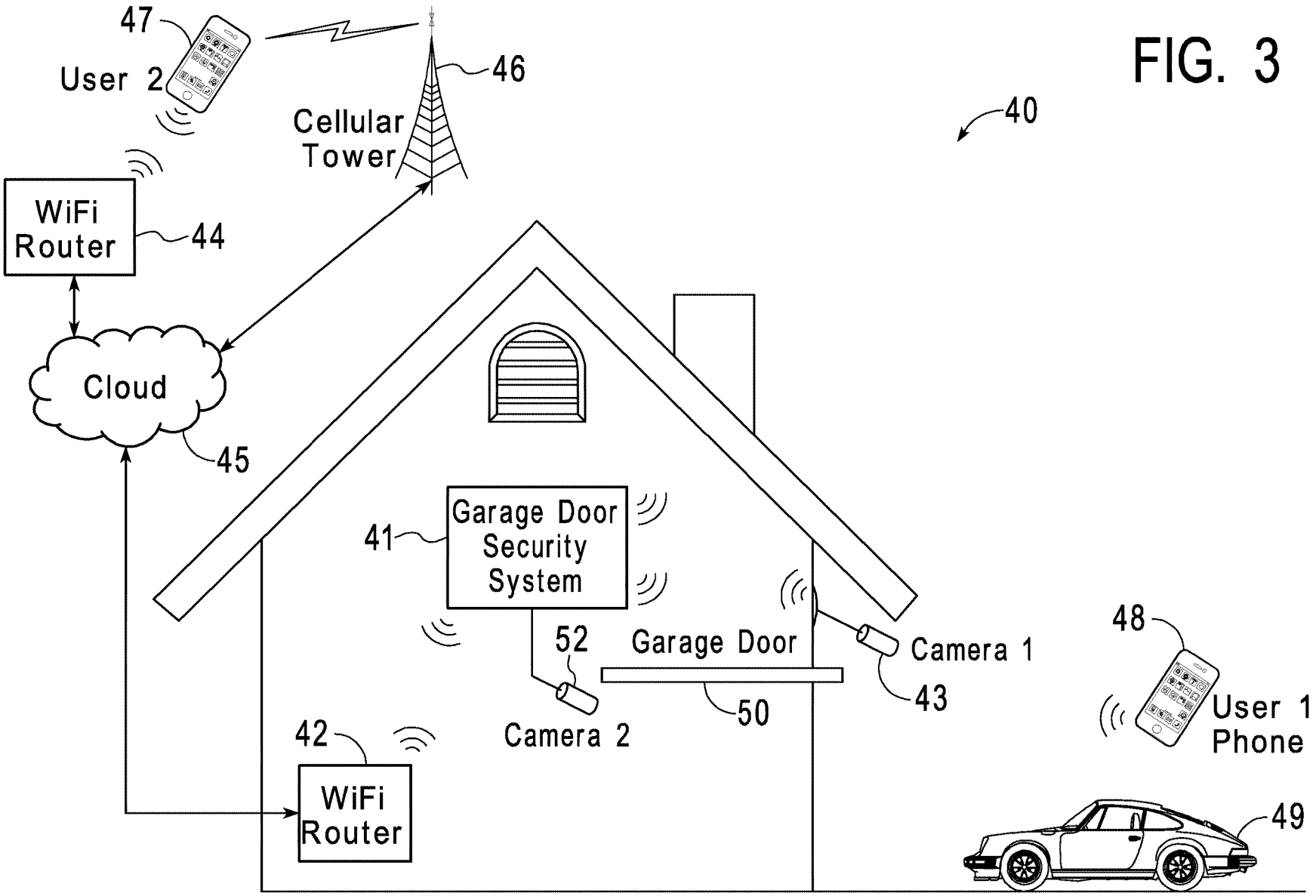
FIG. 3 shows a simplified diagram of components of a garage entry system in accordance with an implementation.

FIG. 3 shows a garage door security system 41 used to open a garage door 50. Garage door security system 41 allows various levels of security.

Garage door security system 41 provides functionality that enhances security of currently available garage door systems. For example, garage door security system 41 communicates wirelessly or through hardwire with a Wi-Fi router 42. When Wi-Fi router 42 is connected to the Internet, this allows a remote user 47 to utilize cloud computing through cloud 45 to interact with garage door security system. For example, user 47 is connected to cloud 45 via a cellular tower 46, a Wi-Fi router 44 or by some other communication connection. Garage door security system 41 can communicates with related devices wirelessly a proprietary private protocol instead of using standard wireless technologies.

Garage door security system 41 is able to use multiple factors to verify and authenticate a user before opening garage door 50. For example, one factor is detecting and authenticating information pertaining to a vehicle 49 approaching garage door 50. The detected information pertaining to vehicle 49 includes, for example, make, model, color and license plate number of vehicle 49. The detected information from captured images of vehicle 49 is compared with stored information to determine whether vehicle 49 is approved for entry into the garage and/or the detected information is compared to track which vehicles entered or attempted entry into the garage.

Another factor is detecting and authenticating vehicle 49 is information pertaining to an occupant of vehicle 49 as vehicle 49 approaches garage door 50. This is done, for example, by evaluating captured images of vehicle 49 to extract images of vehicle 49 occupant and comparing the images of the vehicle occupant with stored images using facial recognition capability to determine whether the vehicle occupant is approved for opening of garage door 50. The detected information is also stored to track who entered or attempted entry into the garage. For example, images of the vehicle occupant are extracted from images that include larger portions of the vehicles where the images are analyzed to detect images of occupants. Alternatively, images of the vehicle occupant are extracted from images that include only portions of the vehicles where it is expected occupants will be located. The occupants of vehicle 49 can be a driver and/or any passengers within vehicle 49.

Additional factors when determining entry include, for example, whether an app on a smart phone has sent a code used to signal garage door security system 41 to open garage door 5, or whether a dedicated garage door remote control has sent a code used to signal garage door security system 41 to open garage door 5.

A user programs garage door security system 41 to determine which authentication factors are to be used to grant access through garage door 50 to the garage. The user can customize the selected factors to balance the ease and convenience of entry through garage door 50 with a desired security level for granting access.

Figure 4:
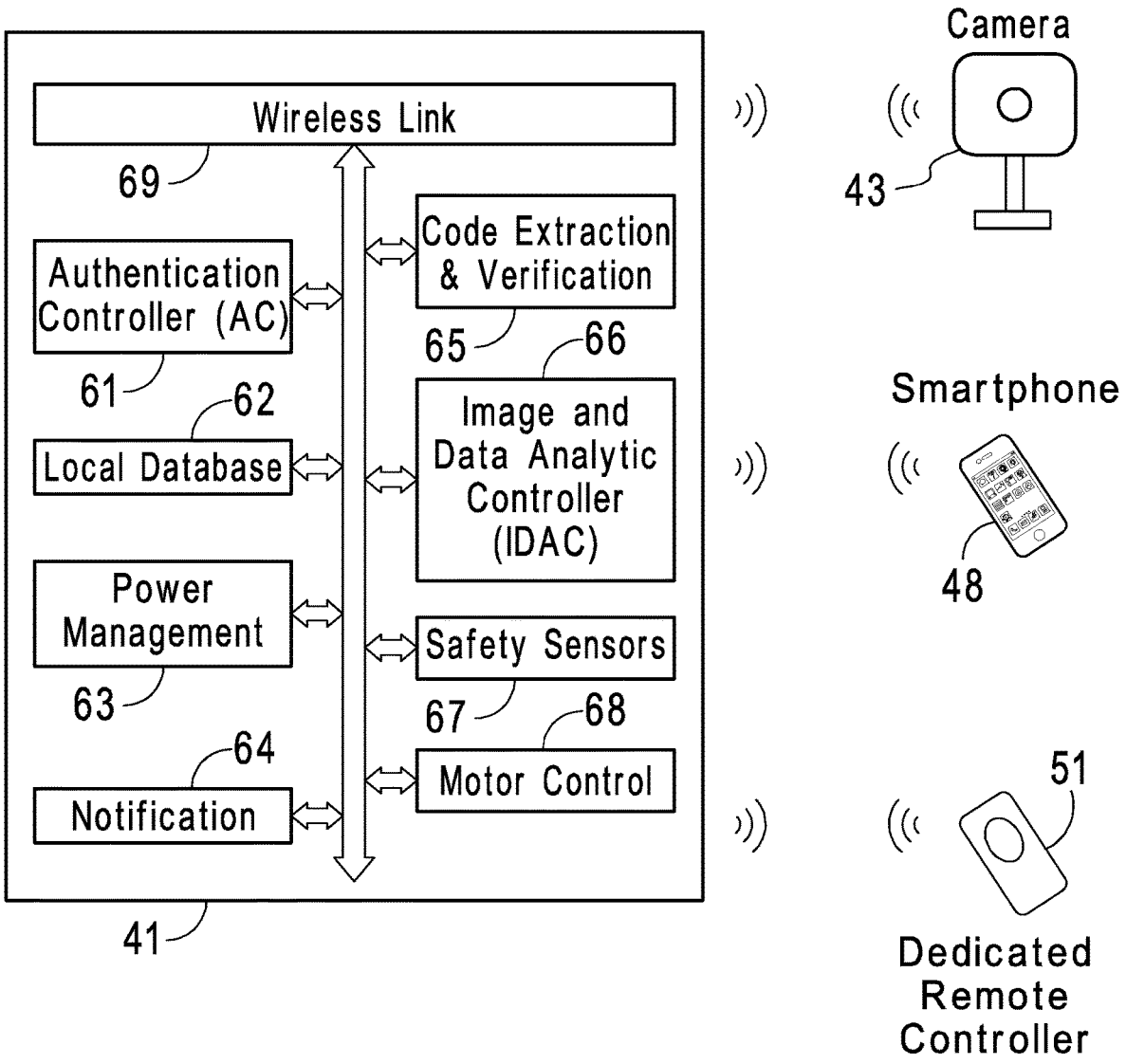
FIG. 4 shows a simplified block diagram providing additional detail of components of a garage entry system in accordance with an implementation.

FIG. 4 shows a simplified block diagram of garage door security system 41 that includes a camera 43 with an infrared light emitting diode (LED), a garage door remote controller 51, an app running on a user smartphone 48, an authentication controller 61, a local database 62, a power management block 63, a notification block 64, a code extraction and verification block 65, a data analytic controller (IDAC) 66, a safety sensors block 67, a motor control block 68 and a wireless link block 69. Users can store vehicle and vehicle occupant information into local database 62. The vehicle and vehicle occupant information can include such information as the make, model, color and license plate number of family vehicles as well as name, contact information and photos of vehicle occupants that can be used for identification and for facial recognition purposes.

For example, IDAC 66 extracts and analyzes captured data from camera 43 and uses image information stored in local database 62 or an external database to perform vehicle and vehicle occupant recognition. The results of the recognition determine for whom garage door 50 is opened and/or provides tracking information stored about who was granted or denied access through garage door 50.

Code extraction and verification block 65 is used to extract and verify a one-time code wirelessly sent by the App on a User's phone or sent by garage door remote controller 51, when this feature is enabled.

Authentication controller block 61 obtains the positive verification results from code extraction and verification block 65 and IDAC 66 to authorize garage door security system 41 to open garage door 50.

Safety sensors block 67 checks obstruction signals sensed by the sensors around and on garage door 50 and stops garage door operation when obstruction is detected. Notification block 64 sends related data through cloud 15 to allow a remote and offsite user to know the open/close status of garage door 50, to allow the remote and offsite user to remotely open/close garage door, to monitor which vehicles enter or attempt to enter through garage door 50 and to monitor the identity and number of people that enter or attempt to enter through garage door 50.

In operation, camera 43 (see FIG. 3) is installed at the exterior of a garage and captures and sends images and/or video through wireless link 60 of garage door security system 41. IDAC 66 extracts and analyzes from the images and/or video a make, model, color and license plate number of vehicle 49 and compares to data stored in local database 62. IDAC 66 extracts and analyzes from the images and/or video a make, model, color and license plate number of vehicle 49 and compares to data stored in local database 62. IDAC 66 can also extract and analyze facial images from captured images that are used to identify occupants using pre-stored data in local database 62. A facial recognition engine inside IDAC 66 is used to perform the recognition based on data stored in local database 62 or a remote database.

If enabled, garage door security system 41 also receives from a garage door remote controller inside vehicle 49 a code that is verified by code extraction and verification block 65. It serves as a second factor to prevent wrongful garage door opening.

Furthermore, if enabled, garage door security system 41 also receives from an app within the user's smartphone 48 a code that is verified by code extraction and verification block 65.

When all enabled factors are verified and authenticated, garage door security system 41 opens garage door 50 allowing access to the garage.

An optional camera 52, shown in FIG. 3, is mounted inside the garage and is used to capture images of people within the garage. Captured images are sent to IDAC 66.

IDAC 66 extracts and analyzes the captured image using pre-stored data in local database 62. Facial recognition engine inside IDAC 66 identifies any known person entering the garage.

Offsite/remote user 47 is notified by notification block 64. For example, the notification includes identification information about a person recognized by IDAC 66 or includes one or more images of a person who IDAC is unable to identify.

The foregoing discussion discloses and describes merely exemplary methods and embodiments. As will be understood by those familiar with the art, the disclosed subject matter may be embodied in other specific forms without departing from the spirit or characteristics thereof. Accordingly, the present disclosure is intended to be illustrative, but not limiting, of the scope of the invention, which is set forth in the following claims.

What is claimed is:

1. A garage door security system, comprising:

a camera configured to capture images of vehicles that are in proximity of a garage door of a garage;

a secret code extraction and verification block that receives a signal including a secret code;

a local database that stores identification information for one or more vehicles, the identification information including at least one of the following:

make;

model;

color; and license plate number;

an image and data analytic controller that analyzes the images of vehicles captured by the camera using at least the identification information for the one or more vehicles stored in the local database in order to identify whether a vehicle in an image captured by the camera is authorized to enter the garage; and a motor control configured to open the garage door to provide access to the garage, wherein the garage door security system is configured to receive a user input selecting one or more security factors from a plurality of security factors of the garage door security system, the plurality of security factors including:

identification of a vehicle in an image captured by the camera; and verification of the secret code;

wherein the garage door security system is configured to open the garage door for a vehicle upon satisfaction of the selected one or more security factors.

2. The garage door security system of claim 1, further comprising:

a garage door remote controller;

wherein the secret code extraction and verification block receives the signal from the garage door remote controller;

wherein the security factor of the identification of the vehicle in the image captured by the camera includes the image and data analytic controller using the identification information for the vehicle to identify the vehicle as authorized to enter the garage;

wherein the security factor of the verification of the secret code includes the secret code extraction and verification block receiving from the garage door remote controller a code authorizing entry to the garage.

3. The garage door security system of claim 1, further comprising:

a wireless communication link;

wherein the secret code extraction and verification block receives the signal from a smartphone over the wireless communication link;

wherein the security factor of the identification of the vehicle in the image captured by the camera includes the image and data analytic controller using the identification information for the vehicle to identify the vehicle as authorized to enter the garage;

wherein the security factor of the verification of the secret code includes the secret code extraction and verification block receiving from the smartphone a code authorizing entry to the garage.

4. The garage door security system of claim 1, further comprising:

a garage door remote controller; and a wireless communication link;

wherein the secret code extraction and verification block receives the signal from a smartphone over the wireless communication link or from the garage door remote controller;

wherein the security factor of the identification of the vehicle in the image captured by the camera includes the image and data analytic controller using the identification information for the vehicle to identify the vehicle as authorized to enter the garage;

wherein the security factor of the verification of the secret code includes the secret code extraction and verification block receiving from the smartphone or the garage door remote controller a code authorizing entry to the garage.

5. The garage door security system of claim 1 wherein the local database additionally stores image information for one or more persons, the image information used for facial recognition of a face within an image captured by the camera; and wherein the image and data analytic controller analyzes the images of vehicles captured by the camera to extract an image of a vehicle occupant in order to use the image information to perform facial recognition of the vehicle occupant based on the image information stored in the database.

6. The garage door security system of claim 5, further comprising:

a garage door remote controller; and a wireless communication link;

wherein the secret code extraction and verification block receives the signal from a smartphone over the wireless communication link or from the garage door remote controller;

wherein the plurality of security factors further includes identification of a vehicle occupant in an image captured by the camera;

wherein the security factor of the identification of the vehicle in the image captured by the camera includes the image and data analytic controller using the identification information for the vehicle to identify the vehicle as authorized to enter the garage;

wherein the security factor of the identification of the vehicle occupant in the image captured by the camera includes the image and data analytic controller using the image information for the one or more persons to perform facial recognition of the vehicle occupant to identify the vehicle occupant as authorized to enter the garage; and wherein the security factor of the verification of the secret code includes the secret code extraction and verification block receiving from the smartphone or the garage door remote controller a code authorizing entry to the garage.

7. The garage door security system of claim 1, further comprising:

a second camera located in the garage configured to capture an image including a face of one or more persons in the garage.

8. A garage door security system comprising:

a camera configured to capture images of vehicle occupants within vehicles that are in proximity of a garage door of a garage;

a secret code extraction and verification block that receives a signal including a secret code;

a local database that stores image information for one or more persons, the image information used for facial recognition of a face within an image captured by the camera;

an image and data analytic controller that analyzes the images of vehicle occupants captured by the camera using at least the image information to perform facial recognition of a vehicle occupant based on the image information stored in the database to identify the vehicle occupant; and a motor control configured to open the garage door to provide access into the garage;

wherein the garage door security system is configured to receive a user input selecting one or more security factors from a plurality of security factors of the garage door security system, the plurality of security factors including:

identification of a vehicle occupant in an image captured by the camera; and verification of the secret code;

wherein the garage door security system is configured to open the garage door for a vehicle upon satisfaction of the selected one or more security factors.

9. The garage door security system of claim 8, further comprising:

a garage door remote controller;

wherein the secret code extraction and verification block receives the signal from the garage door remote controller;

wherein the security factor of the identification of the vehicle occupant in the image captured by the camera includes the image and data analytic controller using the image information for the one or more persons to perform facial recognition of the vehicle occupant to identify the vehicle occupant as authorized to enter the garage;

wherein the security factor of the verification of the secret code includes the secret code extraction and verification block receiving from the garage door remote controller a code authorizing entry to the garage.

10. The garage door security system of claim 8, further comprising:

a wireless communication link;

wherein the secret code extraction and verification block receives the signal from a smartphone over the wireless communication link;

wherein the security factor of the identification of the vehicle occupant in the image captured by the camera includes the image and data analytic controller using the image information for the one or more persons to perform facial recognition of the vehicle occupant to identify the vehicle occupant as authorized to enter the garage;

wherein the security factor of the verification of the secret code includes the secret code extraction and verification block receiving from the smartphone a code authorizing entry to the garage.

11. The garage door security system of claim 8, further comprising:

a garage door remote controller; and a wireless communication link;

wherein the secret code extraction and verification block receives the signal from a smartphone over the wireless communication link and from the garage door remote controller;

wherein the security factor of the identification of the vehicle occupant in the image captured by the camera includes the image and data analytic controller using the information for one or more persons to perform facial recognition of the vehicle occupant to identify the vehicle occupant as authorized to enter the garage;

wherein the security factor of the verification of the secret code includes the secret code extraction and verification block receiving from the smartphone or the garage door remote controller a code authorizing entry to the garage.

12. The garage door security system of claim 8, further comprising:

a second camera located in the garage configured to capture an image including a face of one or more persons in the garage.

13. A method for securing a garage against unauthorized entry, the method comprising:

providing a camera configured to capture images of vehicles that are in proximity of a garage door of a garage;

providing a secret code extraction and verification block that receives a signal including a secret code;

storing within a local database identification information for one or more vehicles, the identification information including at least one of the following:

make;

model;

color; and license plate number;

analyzing images of vehicles captured by the camera using the identification information for the one or more vehicles stored in the local database in order to identify whether a vehicle in an image captured by the camera is authorized to enter the garage;

opening the garage door to provide access into the garage; and receiving a user input selecting one or more security factors from a plurality of security factors of the garage door security system, the plurality of security factors including:

identification of a vehicle in an image captured by the camera; and verification of the secret code;

wherein opening the garage door occurs upon satisfaction of the selection one or more security factors.

14. The method of claim 13, further comprising:

receiving the signal from a garage door remote controller;

wherein the security factor of the identification of the vehicle in the image captured by the camera includes using the identification information for the vehicle to identify the vehicle as authorized to enter the garage;

wherein the security factor of the verification of the secret code includes a secret code extraction and verification block receiving from the garage door remote controller a code authorizing entry to the garage.

15. The method of claim 13, further comprising:

receiving the signal from a smartphone;

wherein the security factor of the identification of the vehicle in the image captured by the camera includes using the identification information for the vehicle to identify the vehicle as authorized to enter the garage;

wherein the security factor of the verification of the secret code includes a secret code extraction and verification block receiving from the smartphone a code authorizing entry to the garage.

16. The method of claim 13, further comprising:

receiving the signal from a smartphone; or receiving the signal from a garage door remote controller;

wherein the security factor of the identification of the vehicle in the image captured by the camera includes using the identification information for the vehicle to identify the vehicle as authorized to enter the garage;

wherein the security factor of the verification of the secret code includes a secret code extraction and verification block receiving from the smartphone or the garage door remote controller a code authorizing entry to the garage.

17. The method of claim 13, further comprising:

storing in the local database image information for one or more persons, the image information used for facial recognition of a face within an image captured by the camera; and analyzing the images of vehicles captured by the camera to extract an image including a face of a vehicle occupant to perform facial recognition of the vehicle occupant based at least in part on the image information stored in the database.

18. The method of in claim 17, further comprising:

receiving the signal from a smartphone; or receiving the signal from a garage door remote controller;

wherein the plurality of security factors further includes identification of a vehicle occupant in an image captured by the camera;

wherein the security factor of the identification of the vehicle in the image captured by the camera includes using the identification information for the vehicle to identify the vehicle as authorized to enter the garage;

wherein the security factor of the identification of the vehicle occupant in the image captured by the camera includes using the image information for the one or more persons to perform facial recognition of the vehicle occupant to identify the vehicle occupant as authorized to enter the garage;

wherein the security factor of the verification of the secret code includes the secret code extraction and verification block receiving from the smartphone or the garage door remote controller a code authorizing entry to the garage.

19. The method of claim 13, further comprising:

configuring a second camera located in the garage to capture an image including a face of one or more persons in the garage.

* * * * *